US011885597B2

(12) United States Patent
Klise et al.

(10) Patent No.: US 11,885,597 B2
(45) Date of Patent: Jan. 30, 2024

(54) MODULAR ARMORED COMPONENTS FOR VEHICLES

(71) Applicant: BATTELLE MEMORIAL INSTITUTE, Columbus, OH (US)

(72) Inventors: Robert E. Klise, Hilliard, OH (US); Trey Musgrove, III, Sunbury, OH (US); Corey B. Matthews, Hilliard, OH (US); Keith Riley, Lexington, OH (US); Luke T. Kelm, Columbus, OH (US); W. Fred Lyon, Marengo, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 17/900,556

(22) Filed: Aug. 31, 2022

(65) Prior Publication Data

US 2023/0358512 A1 Nov. 9, 2023

Related U.S. Application Data

(60) Provisional application No. 63/239,172, filed on Aug. 31, 2021.

(51) Int. Cl.
*F41H 7/04* (2006.01)

(52) U.S. Cl.
CPC ..... *F41H 7/048* (2013.01); *F41H 7/042* (2013.01)

(58) Field of Classification Search
CPC ..... F41H 5/223; F41H 5/226; F41H 7/044; F41H 7/048
See application file for complete search history.

(56) References Cited

U.S. PATENT DOCUMENTS

| | | | | |
|---|---|---|---|---|
| 10,495,419 | B1 * | 12/2019 | Krueger | F41H 7/044 |
| 11,255,642 | B1 * | 2/2022 | Rasico | F41H 5/226 |
| 2014/0216238 | A1 * | 8/2014 | Pfennig | F41H 5/02 89/36.02 |
| 2018/0364012 | A1 * | 12/2018 | Iotti | F41H 5/226 |

* cited by examiner

*Primary Examiner* — J. Woodrow Eldred
(74) *Attorney, Agent, or Firm* — Grossman, Tucker, Perreault & Pfleger, PLLC; Edmund P. Pfleger

(57) ABSTRACT

The present disclosure provides a modular armored vehicle system that includes a plurality of armored components removably affixed to a vehicle frame, wherein the plurality of armored components includes an armored roof component comprising a forward roof section, a middle roof section, and a rear roof section, wherein each of the plurality of armored components comprise a plurality of bends to form-fit onto the vehicle frame. The modular armored vehicle system further includes a first side armored component of the plurality of armored components removably affixed to the vehicle frame, wherein the first side armored component comprises a flange portion to overlap the armored roof component. Further, the modular armored vehicle component further includes a side pillar armored component of the plurality of armored components removably affixed to the vehicle frame.

20 Claims, 11 Drawing Sheets

MODULAR ARMORED COMPONENTS FOR VEHICLES

RELATED APPLICATIONS

This patent application claims priority to U.S. Provisional Application No. 63/239,172, filed Aug. 31, 2021, the entirety of which is incorporated herein by reference.

TECHNICAL FIELD

The present disclosure relates to modular armored components for vehicles.

BRIEF SUMMARY OF THE INVENTION

In an embodiment, a modular armored vehicle system is described, wherein the system may include a plurality of armored components removably affixed to a vehicle frame. For example, the plurality of armored components may include an armored roof component having a forward roof section, a middle roof section, and a rear roof section, wherein each of the plurality of armored components may include a plurality of bends to form-fit onto the vehicle frame. Further, the modular armored vehicle system may include a first side armored component of the plurality of armored components removable affixed to the vehicle frame, wherein the first side armored component comprising a flange portion to overlap the armored roof component. Furthermore, the modular armored vehicle system may include a side pillar armored component of the plurality of armored components removably affixed to the vehicle frame.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
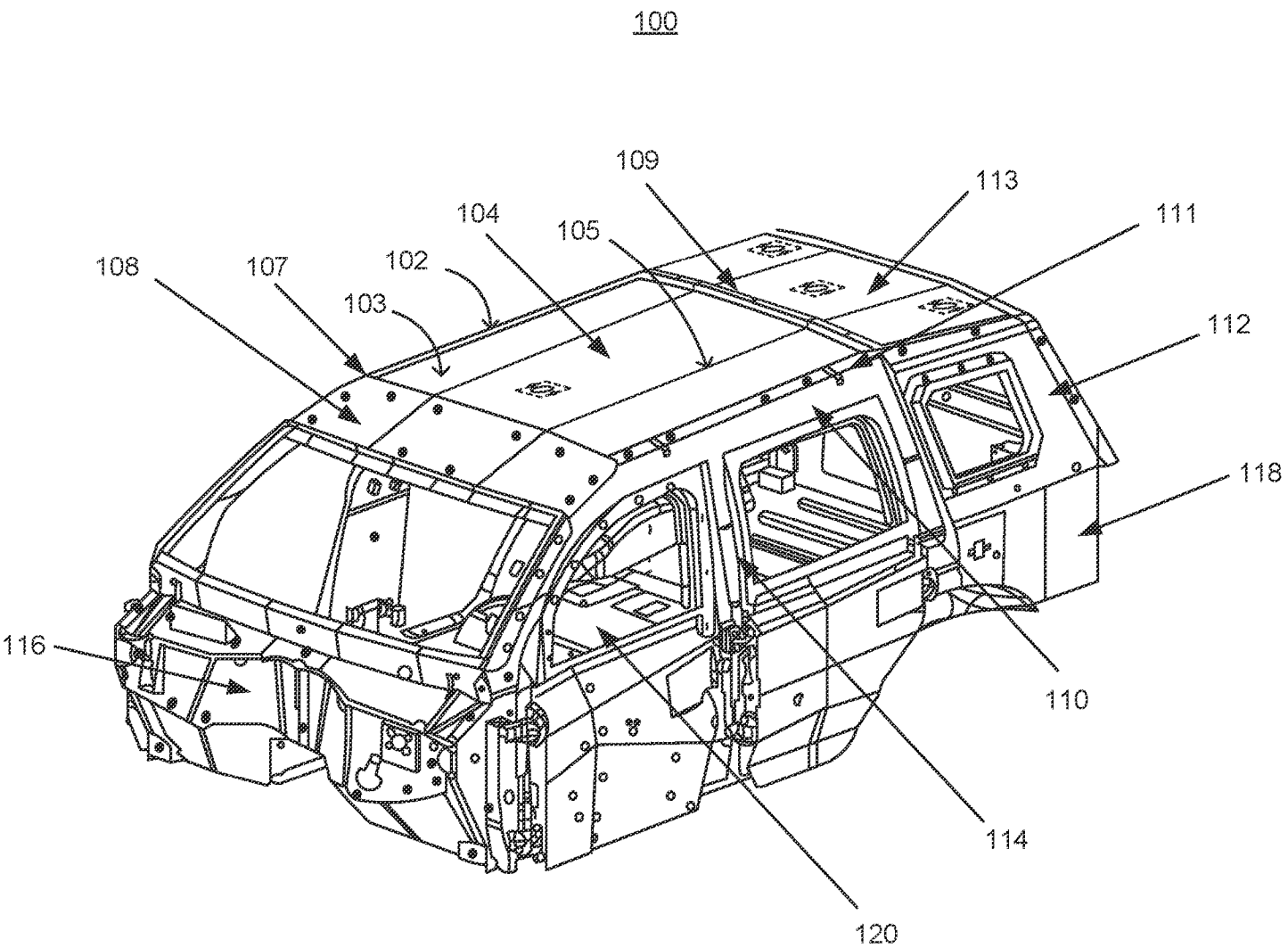
FIG. 1 illustrates a perspective view of modular armored components for a vehicle in accordance with several embodiments of the present disclosure.

Although the following Detailed Description will proceed with reference being made to illustrative embodiments, many alternatives, modifications and variations thereof will be apparent to those skilled in the art.

DETAILED DESCRIPTION

Embodiments of the present invention recognize that vehicles in service in territories or regions that are subject to ballistic attacks are more vulnerable to significant damage if equipped with segmented armor. To reduce the likelihood of significant damage to such vehicles, embodiments described herein employ modular armored vehicle systems and apparatuses designed to provide greater protection to ballistic attacks from any direction towards the vehicle.

For example, in an embodiment, a modular armored vehicle system may include a plurality of armored components removably affixed to a vehicle frame. Further, the plurality of armored components may include an armored roof component having a forward roof section, a middle roof section, and a rear roof section, wherein each of the plurality of armored components may include a plurality of bends to form-fit onto the vehicle frame. Furthermore, the modular armored vehicle system may include a first side armored component of the plurality of armored components removable affixed to the vehicle frame, wherein the first side armored component comprising a flange portion to overlap the armored roof component. Even further, the modular armored vehicle system may include a side pillar armored component of the plurality of armored components removably affixed to the vehicle frame.

In an embodiment, the modular armored vehicle system may include a firewall armored component removably affixed to the vehicle frame, wherein the firewall armored component may be disposed between an engine compartment of the vehicle and a passenger compartment of the vehicle.

In an embodiment, the modular armored vehicle system may include a rear armored component removably affixed to the vehicle frame, a rear lower armored component removably affixed to the vehicle frame, and a floor panel armored component removably affixed to the vehicle frame. Further, in an embodiment, the armored components may be removably affixed to the vehicle frame using a plurality of bolts and may be formed of ballistic-rated steel. Even further, the modular armored components may be manufactured or sourced to comply with an Overseas Security Policy Board (OSPB) blast/impact specifications.

In yet another embodiment, a modular armored vehicle apparatus is disclosed herein, wherein the modular armored vehicle apparatus may include an armored roof component comprising a forward roof section, a middle roof section, and a rear roof section, wherein the forward roof section is laterally secured to the middle roof section, and the middle roof section is laterally secured to the rear roof section.

Further, in an embodiment, the modular armored vehicle apparatus may include a first side armored component vertically secured to the armored roof component, wherein the first side armored component may include a first forward section defining a first front passenger door and a first rear section defining a first rear passenger door.

Furthermore, in an embodiment, the modular armored vehicle apparatus may include a second side armored component distally opposed to the first side armored component and vertically secured to the armored roof component, wherein the second side armored component may include a second forward section defining a second front passenger door and a second rear section defining a second rear passenger door.

Even further, in an embodiment, the modular armored vehicle apparatus may include a rear armored component secured to corresponding rear portions of the armored roof component, wherein the first side armored component, the second side armored component, and the rear armored component comprising a rear armored ballistic swing door may be secured using an armored hinge component.

Even further, in an embodiment, the modular armored vehicle apparatus may include a firewall armored component secured to corresponding front portions of the first side armored component and the second side armored component, wherein the firewall armored component may be disposed between an engine compartment and a passenger compartment of a vehicle frame.

Even further, in an embodiment, the modular armored vehicle apparatus may include a floor panel armored component secured to corresponding bottom portions of the first side armored component, the second side armored component, and the firewall armored component, wherein the armored roof component, the first side armored component, the second side armored component, the rear armored component, and the firewall armored component may be secured to the vehicle frame using a plurality of bolts.

Even further, in an embodiment, the modular armored vehicle apparatus may include a rear lower armored component comprising an upper portion secured to a lower portion of the rear armored component and the rear lower armored component may include forward portions secured to corresponding lower rear portions of the of the first side armored component and the second side armored component.

Even further, in an embodiment, the modular armored vehicle apparatus may include a first side pillar component secured to a first exterior surface of the first side armored component, wherein the first side pillar component may include first armored hinge components to secure first passenger doors to the first side armored component.

Even further, in an embodiment, the modular armored vehicle apparatus may include a second side pillar component secured to a second exterior surface of the second side armored component, wherein the second side pillar component may include second armored hinge components to secure a second passenger doors to the second side armored component.

Embodiments of the invention will now be described with reference to the Figures.

FIG. 1 illustrates a perspective view 100 of modular armored components for a vehicle in accordance with several embodiments of the present disclosure. The modular armored components may include an armored roof component 102 to provide roof armor that spans the length of a vehicle roof. In one example embodiment illustrated in FIG. 1, armored roof component 102 may be formed of a single section of ballistic-rated material that includes a first plurality of bends at locations 103 and 105 to form-fit over a vehicle frame. In one embodiment, armored roof component 102 may also include a second plurality of bends 107 and 109 running generally perpendicular to bends at locations 103 and 105 to define a forward roof section 108, a middle roof section 104 and a rear roof section 113. The armored roof component 102 may be removably affixed to the vehicle frame using bolts (one or which is illustrated at 108). The size and material strength of the bolts 108, as described herein for any of the components, may be selected based on, for example, a desired blast/impact tolerance and/or sheer/tensile strength tolerance.

The modular armored components may also include one or more side armor components (e.g., first side armored component) to provide impact/blast protection for the side of a vehicle. In one example embodiment illustrated in FIG. 1, the side armor components may include a front side component 110 (e.g., first side armored component) and a rear side component 112 (e.g., second side armored component). The front side component 110 is dimensioned to generally surround the front and rear passenger windows and spans the length of the vehicle from the firewall (engine compartment) to the rear side component 112. The front side component 110 may include a flange portion (e.g., upper flange portion 111) to overlap the middle roof section 104. Providing overlap between modular components provides significant advantages by enhancing blast/shock force distribution among neighboring components, thus significantly adding to the overall effectiveness and integrity of the armored vehicle. Accordingly, in any of the embodiments herein, each of the components and/or segments may include flange portions (e.g., similar to flange portion 111) to provide overlapping with adjacent components/segments.

The modular armored components may also include side pillar stiffener/reinforcement component 114 (e.g., side pillar component), for example, as illustrated between the front door and the rear door to provide greater side blast/impact protection. The modular armored components may also include a firewall component 116 disposed between the engine compartment and the passenger compartment. The modular armored components may also include rear lower components 118 generally disposed near the lower corners of the vehicle. In an embodiment, the modular armored components may also include a floor panel armored component 120 to provide greater blast/impact protection coming from beneath the vehicle. Each of these armored components may include a flange to overlap with adjacent segments.

The modular armored components described herein offer significant advantages over current armored vehicle designs. For example, the modular components enable efficient field replacement of one or more components without requiring the re-armoring of the entire vehicle. In addition, the modular armored components described herein may be bolted onto the vehicle frame (as opposed to welding/permanent fixation), thus enabling efficient removal and installation. The overlapping seams of the modular armored components provide efficient load distribution to adjacent components, thus providing enhanced overall strength and impact protection. The modular armored components may be dimensioned to fit on any vehicle. The modular armored components may comply or be compatible with industry standard blast/impact specifications, such as the Overseas Security Policy Board (OSPB) blast/impact specifications. The modular armored components may be formed of ballistic-rated steel and/or other known ballistic-rated materials. In addition, the modular armored components as shown and described herein may provide 360 degrees of ballistic protection and minimal heat affected zone (HAV) due to less welding. In addition, to the extent welding may be used for a given application, the modular armored components shown and described herein provide improved welding capabilities since welds can be performed before the components are attached to a vehicle frame. In addition, using bolts instead of welding as described herein improves corrosion resistance and significantly reduces installation time.

Figure 2:
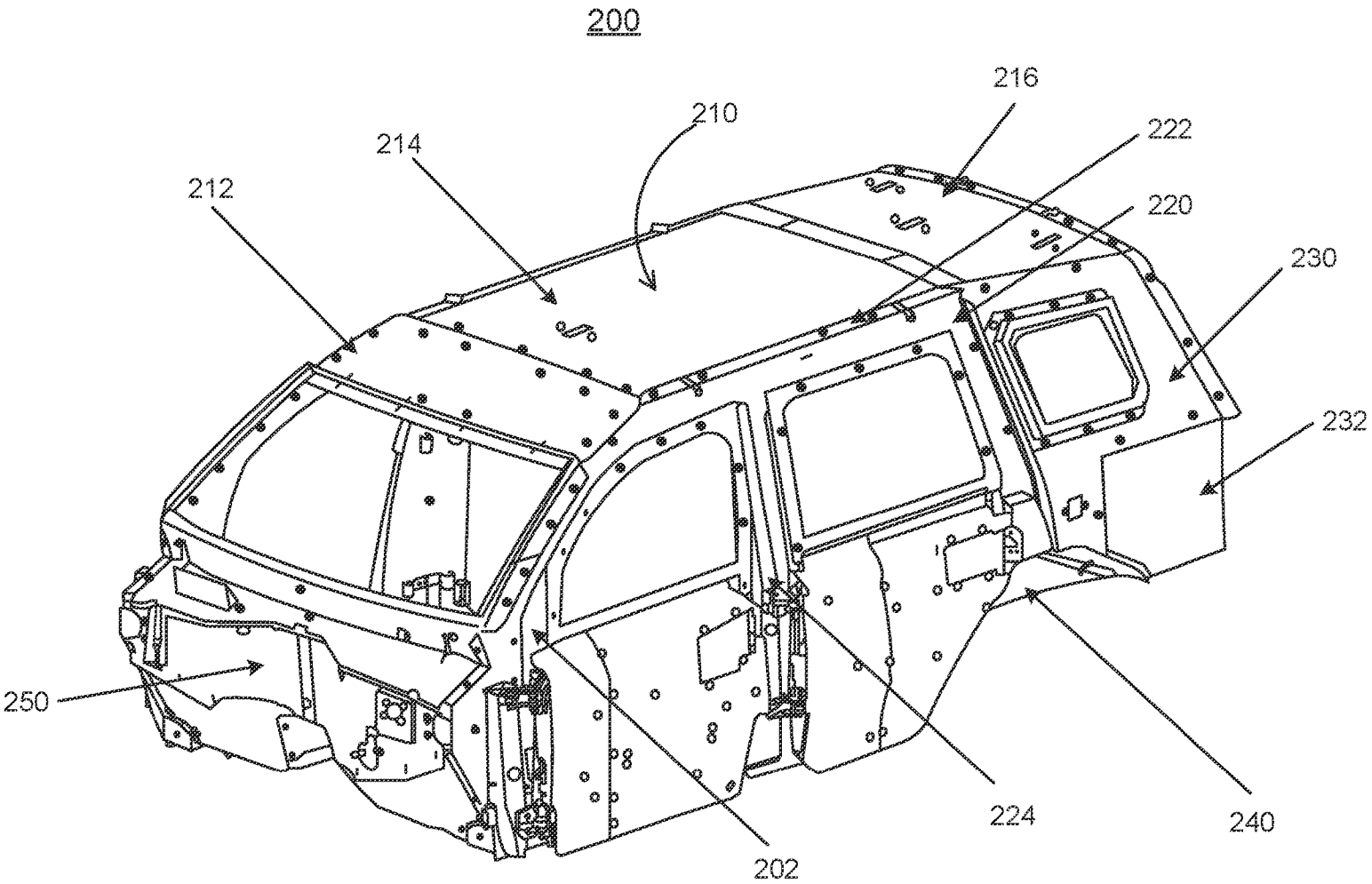
FIG. 2 illustrates an alternate perspective view of modular armored components for a vehicle in accordance with several embodiments of the present disclosure.

FIG. 2 illustrates a perspective view 200 of modular armored components for a vehicle in accordance with several embodiments of the present disclosure. In an embodiment, the modular armored components may include an armored roof component 210 removably affixed to a vehicle frame 202 via a plurality of bolts.

In an embodiment, the armored roof component 210 may include a forward roof section 212 having a front end secured to an upper portion of a windshield opening corresponding to windshield flange, as shown in FIG. 2. Further, the forward roof section 212 may include a rear end distally opposed from the front end, wherein the rear end may be secured to a front portion of a middle roof section 214 of the armored roof component 210. Furthermore, the middle roof section may include a rear portion secured to a front portion of a rear roof section 216, wherein the rear roof section 216 may include a rear portion secured to a top portion of a rear armored component 230. Even further, the armored roof component 210 may include a plurality of bends to form-fit over the vehicle frame, wherein the armored roof component 210 may be secured to the vehicle frame using bolts installed proximate to the plurality of bends.

In an embodiment, the armored roof component 210 may be secured to at least one of side armored component 220 (e.g., first side armored component 220A, second side armored component 220B) along opposite sides of the armored roof component 210. For example, the modular armored components may include a first side armored component 220A (e.g., side armored component 220) having a top portion secured to the armored roof component 210 lengthwise along the forward roof section 212 and the middle roof section 214 via flange portion 222. Further, the modular armored components may include a second side armored component 220B (not shown) having a top portion secured to the armored roof component 210 lengthwise along the forward roof section 212 and the middle roof section 214 via a second flange portion (not shown). In an embodiment, side armored component 220 may include transparent armor corresponding to one or more windows.

In an embodiment, the modular armored components may include opaque armor as the material for the armored components. For example, the opaque armor may be securely attached to interior surfaces of the vehicle frame, vehicle body, or to other armor, wherein the welds to secure the opaque armor may not exceed 1.0" and spaced apart by no more than 1.0".

In an embodiment, during assembly of the modular armored components, larger welded subassemblies may be utilized to minimize the number of bolts used to secure the modular armored components to other modular armored components and/or the vehicle frame.

In an embodiment, the modular armored components may include opaque armor returns secured in all door and window openings. Additionally, the distance between the opaque armor return and door opaque armor panels may vary and may be subject to a type of finish (e.g., plastic, vinyl) used. For example, a windshield armor return may include a roof header, an A-pillar, and a cowling. Further, in an embodiment, the modular armored components may include perimeter armor configured to cover bolts used to install and secure door armor, for example. In other words, the armor returns may be installed and secured on inner surfaces of door armor.

In an embodiment, the modular armored components for a vehicle may include side pillar component 224 (e.g., side pillar stiffener/reinforcement component 114) secured to the vehicle frame 202 between the front door and the rear door to provide greater side blast/impact protection. For example, the side pillar component 224 may include a top portion secured to the vehicle frame 202 proximate to the front portion of the middle roof section 214 of the armored roof component 210. Further, for example, the side pillar component 224 may include a bottom portion secured to the vehicle frame 202 proximate to a bottom portion of the side armored component 220 and a floor panel armored component 240 secured to the undercarriage of the vehicle frame.

In an embodiment, the modular armored components for a vehicle may include the rear armored component 230 comprising the top portion secured to the rear portion of rear roof section 216 and a bottom portion secured to a rear lower armored component 232. For example, the rear armored component 230 may be configured to secure/protect occupants of a rear passenger compartment of the vehicle from a rear blast or rear impact. In an embodiment, rear armored component 230 may include transparent armor corresponding to a rear windshield, and one or more side windows.

In an embodiment, the modular armored components for a vehicle may include the rear lower armored component 232 secured to the bottom portion of rear armored component 230 and a rear portion of a floor panel armored component 240.

In an embodiment, the modular armored components for a vehicle may include the floor panel armored component 240 secured to a bottom portion of the rear armored component 230 and a front portion of the rear lower armored component 232, wherein the floor panel armored component is removably fixed to an undercarriage of the vehicle frame and configured to provide greater protection to the vehicle from underside blast/impact events. For example, the floor panel armored component 240 may include subassemblies (e.g., a left front floor assembly, a right front floor assembly, a transmission tunnel assembly, a second-row seat floor assembly, a cargo floor assembly), wherein the subassemblies may be bolted to adjacent components to form an interconnected floor assembly. In an embodiment, for example, the floor panel armored component 240 may be manufactured with MIL-DTL-12560, from the top of the toe board to a rear swing door securely connected to the rear armored component 230. Further, for example, floor panel armored component 240 may be composed by tacking weld pieces in position prior to final welding to achieve continuous full penetration. Furthermore, floor panel armored component 240 may include a laminated armor panel that may be bonded to steel, wherein the laminated armor panel may be composed of 1 uniform piece from the front to the rear of the vehicle frame. For example, the laminated armor panel may be composed of up to 7 layers of MIL-DTL-62474 type 2 Class B, or Composiflex product.

In an embodiment, the modular armored components for a vehicle may include a firewall armored component 250 disposed between an engine compartment and the passenger compartment of the vehicle frame. In an embodiment, the firewall armored component 250 may include a first side portion secured to the first side armored component 220A and a second side portion secured to the second side armored component 220B. Further, the firewall armored component 250 may include a top portion (e.g., flange portion) secured to transparent armor (e.g., windshield) forming a contiguous connection between the firewall armored component 250 and the windshield, wherein all firewall components may be secured to each other by continuous welding and subsequently secured to the vehicle frame by a plurality of bolts. In an embodiment, the firewall armored component 250 may be composed of material to allow all wiring harnesses, HVAC, and cables passing through the firewall from the engine compartment to be protected by a minimum of 3/16" MIL-DTL-46100E steel.

Figure 3:
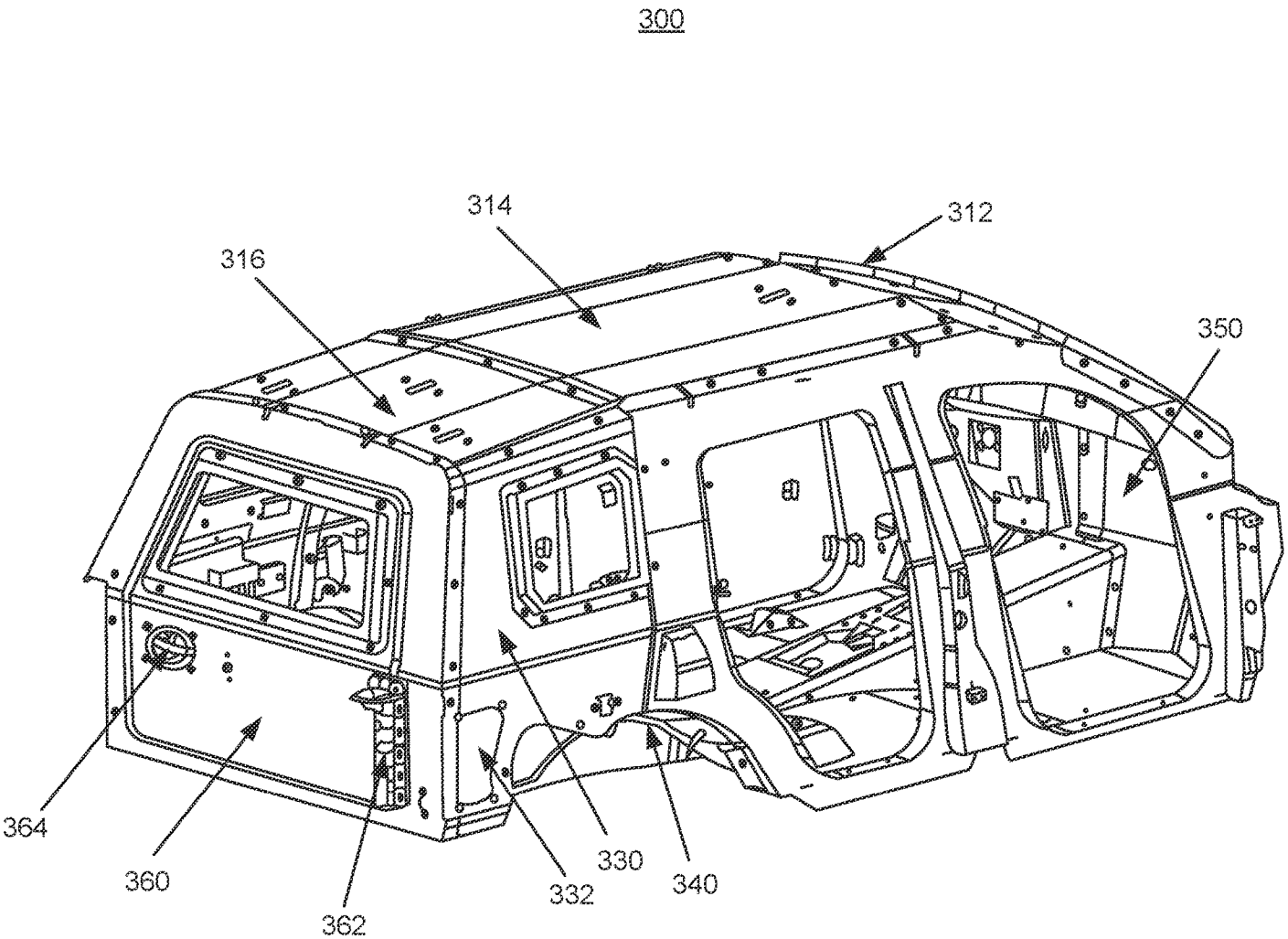
FIG. 3 illustrates a rear perspective view of modular armored components for a vehicle according to one embodiment of the present disclosure.

FIG. 3 illustrates a rear perspective view 300 of modular armored components for a vehicle according to one embodiment of the present disclosure.

In an embodiment, the modular armored components illustrated in rear perspective view 300 may include a rear armored component 330 having a top portion secured to a lower side portion of a rear roof section 316 and a bottom portion secured to a rear lower armored component 332. For example, the rear armored component 330 may be configured to secure/protect occupants of a rear passenger compartment of the vehicle from a rear blast or rear impact. In an embodiment, rear armored component 330 may include transparent armor corresponding to one or more side windows. For example, water resistant rubber seals may be secured around a perimeter of the transparent armor to provide leak protection from air, liquid or gases when closed against the vehicle frame.

In an embodiment, the modular armored components for a vehicle may include the rear lower armored component 332 secured to the bottom portion of rear armored component 330 and a rear portion of a floor panel armored component 340.

In an embodiment, the modular armored components for a vehicle may include a rear ballistic swing door 360 removably secured to the rear armored component 330 via an armored hinge component 362 (e.g., armored hinge mount) and an armored door latch 364. In an embodiment, the rear ballistic swing door 360 may include an opening configured to secure transparent armor (e.g., armored windshield) via opaque armor returns secured within the frame of the opening, wherein the transparent armor may be secured to the rear ballistic swing door 360 using bolts at the exterior of the rear ballistic swing door 360 with weld nuts or studs, for example. In an embodiment, the rear ballistic swing door 360 may include a frame comprising returns installed around the rear ballistic swing door 360 full perimeter, wherein the returns may be the same or within 1%-10% of the same thickness of the rear ballistic swing door 360 thickness. Further, the frame of the rear ballistic swing door 360 may be located between the rearmost pillars of the rear armored component 330. One of ordinary skill in the art recognize that the thickness of the modular armored components would be based on a particular operating environment and/or ballistic protection requirements. Further, one or more modular armored components may have a thickness that is different from the other modular armored components, based on the particular application requirements in the field.

Figure 4:
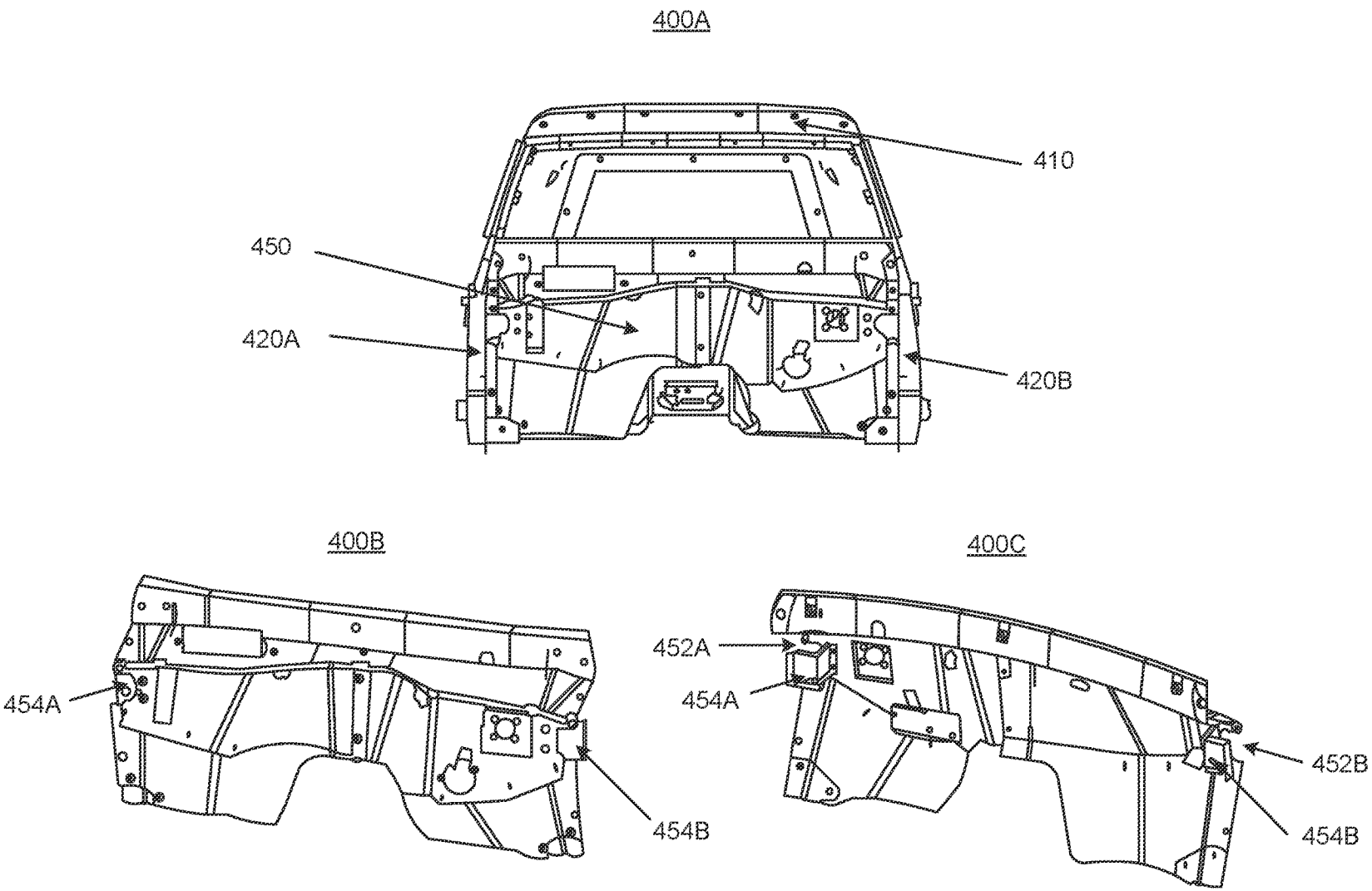
FIG. 4 illustrates firewall front and rear views of modular armored components for a vehicle according to one embodiment of the present disclosure.

FIG. 4 illustrates firewall front and rear views 400A, 400B, and 400C of modular armored components for a vehicle according to one embodiment of the present disclosure.

In an embodiment, a front view 400A of the modular armored components for a vehicle may include firewall armored component 450 secured to the vehicle frame forming a barrier between the engine compartment and the passenger compartment of the vehicle. Further, the firewall armored component 450 may include a first side portion secured to a first side armored component 420A and a second side portion secured to a second side armored component 420B, wherein the first side portion of the firewall armored component 450 is distally opposed from the second side portion of the firewall armored component 450.

In an embodiment, a front perspective view 400B and a back perspective view 400C of the firewall armored component 450 may further include one or more firewall access points (e.g., pass throughs) defining an opening in the body of the firewall armored component 450. For example, a first firewall access point 452A may define an opening in the first side of the firewall armored component 450 proximate to the first side armored component 420A and a second firewall access point 452B may define an opening in the second side of the firewall armored component 450 proximate to the second side armored component 420B. Additionally, for example, the firewall armored component 450 may include armored cover plates secured to the body of the firewall armored component 450 and extending beyond the opening of the firewall access points. For example, a first armored cover plate 454A and/or a second armored covered plate 454B may extend beyond the opening size of the firewall access points by up to 1" to provide sufficient coverage to protect against ballistics, projectiles, or any other intrusive member or energy source entering the vehicle passenger compartment. In an embodiment, the one or more firewall access points may have dimensions corresponding to a diameter of 1.5", or 1.5" length by 3.0" width, wherein the dimensions may vary within a tolerance of +/−3" to accommodate pass through access of wires, cables, or other power or communication mediums between the passenger compartment and the engine compartment.

In an embodiment, the modular armored components for a vehicle may include additional access points or pass throughs to accommodate pass through access of wires, cables, or other power or communication mediums between interior and exterior thresholds of the vehicle frame and corresponding compartments. For example, the armor pass throughs may be configured to provide protection against splash from oblique shots and include symmetrical bolt patterns to allow installation with exits pointing towards the front or rear of the component. Further, for example, the armor pass throughs may include an opening corresponding to one or more 90 degrees turn geometry that allows entering and exiting cables to undergo a small bend radius.

In an embodiment, the modular armored components may include roof armor pass throughs having a 1½" by 4" opening in the armored roof component, wherein the roof armor pass throughs may also include a 1" overlap around the opening and a 1" opening for a cable route.

In an embodiment, a plurality of floor pass throughs (e.g., 2 floor access points) may be defined within the floor panel armored component (not shown) defining openings with similar dimensions of the firewall access points, wherein an armor cover plate may be removably attached to the floor access points. Further, for example, the armor cover plates may include dimensions that extend up to 0.5" beyond the opening size of the floor access points and removable from the vehicle interior.

Figure 5:
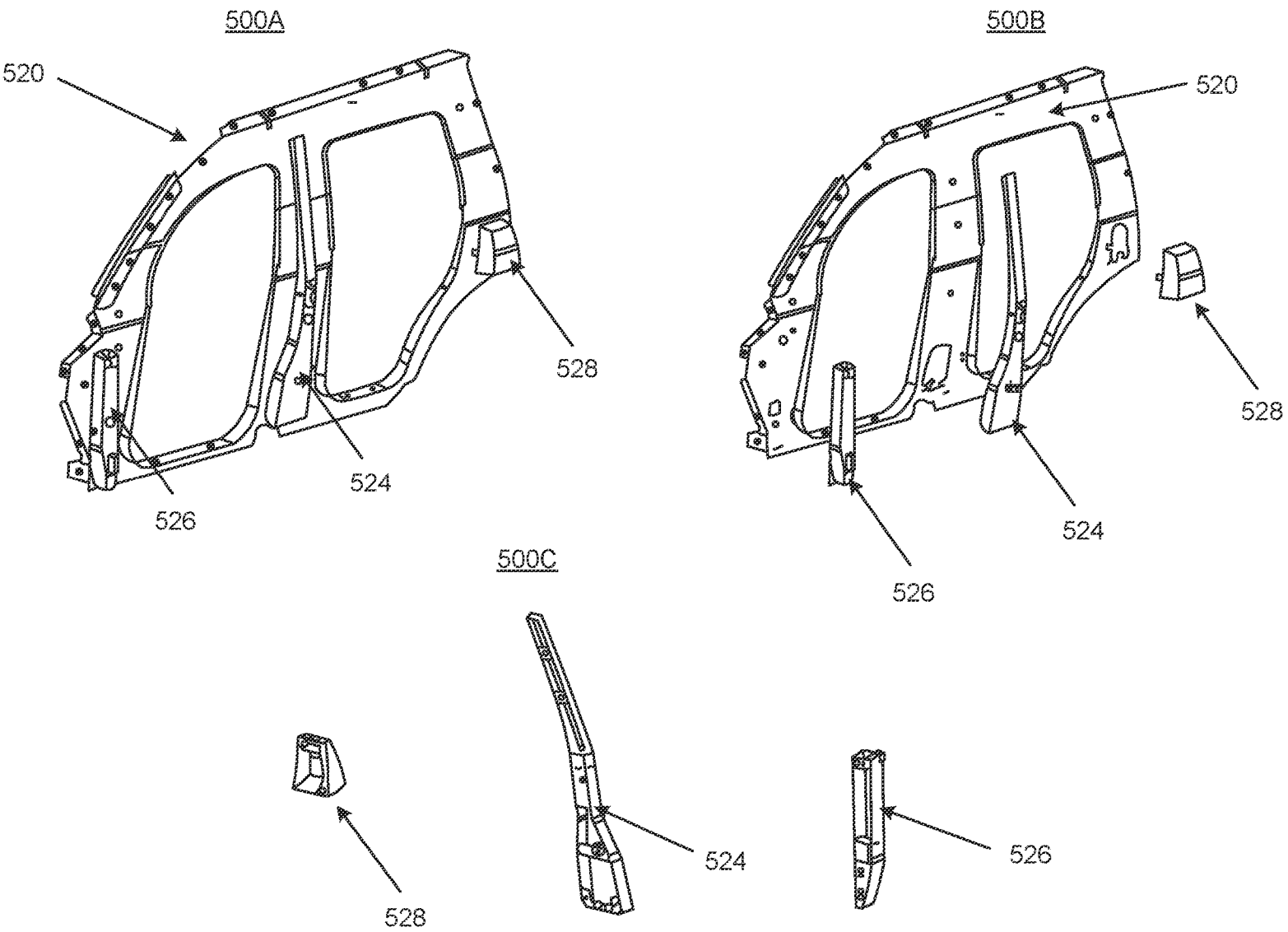
FIG. 5 illustrates perspective views of modular armored components corresponding to pillar hinge mounts for a vehicle according to one embodiment of the present disclosure.

FIG. 5 illustrates a side perspective view 500 of a pillar of modular armored components for a vehicle according to one embodiment of the present disclosure.

In an embodiment, the modular armored components may include a side pillar component 524 secured to the vehicle frame between the front door opening and the rear door opening to provide greater side blast/impact protection. For example, the side pillar component 524 may include a top portion secured to the vehicle frame proximate to the front portion of the middle roof section 514 of the armored roof component 210. Further, for example, the side pillar component 524 may include a bottom portion secured to the vehicle frame proximate to a bottom portion of the side armored component 520 and a floor panel armored component 240 secured to the undercarriage of the vehicle frame. In an embodiment, the modular armored components may be composed of materials corresponding to armor plate per MIL-DTL-46100 and/or MIL-DTL-32332.

In an embodiment, the modular armored components may include pillar armor corresponding to "A" pillars that may be secured as armor from the front roof header to the floor sill plate, wherein all other pillars may be fully covered from the roof to the floor of the vehicle. Further, in an embodiment, the opaque armoring materials may be installed and secured over the right and left wheel housing areas where those areas intrude into the passenger compartment of the vehicle, wherein these armoring materials may correspond to a perimeter armor. Furthermore, opaque roof armor may be installed inside the entire roof area of the vehicle, thereby utilizing the fewest number of armor pieces as possible, wherein the roof armor may be designed such that it is secured below the windshield armor.

In an embodiment, the modular armored components may include a pillar armor to door interface, wherein a "U" channel reinforcement structure shall be provided and secured behind each kick-plate armor panel and used to anchor the front door hinges. Further, the "U" channel reinforcement structure shall be provided and secured behind each "B" pillar armor panel and may be used to anchor the rear door hinges. Even further, a C Pillar "U" channel reinforcement structure may depend on the vehicle type, wherein the "U" channel reinforcement structure may be configured to serve to provide ballistic protection for wiring harnesses, pass-through holes, seat belts, and seat belt anchor points. Furthermore, where structurally permitted, the legs of the "U" channel reinforcement may be mechanically restrained (e.g., welded) to the floor armored component and to the roof armored component. In other words, the reinforcements may be integrated behind armor panels and used to anchor door hinges, wherein the armor panels may be coated with a corrosion-resistant material.

Furthermore, the pillar armor and other armored components may be configured and installed to protect all vital vehicle control modules or systems to ensure continued vehicle operability during a ballistic or blast event for the applicable protection level. For example, the modular armored components may be installed and secured to the vehicle frame to armor the engine control unit (ECU), battery perimeter and main fuse box.

Figure 6:
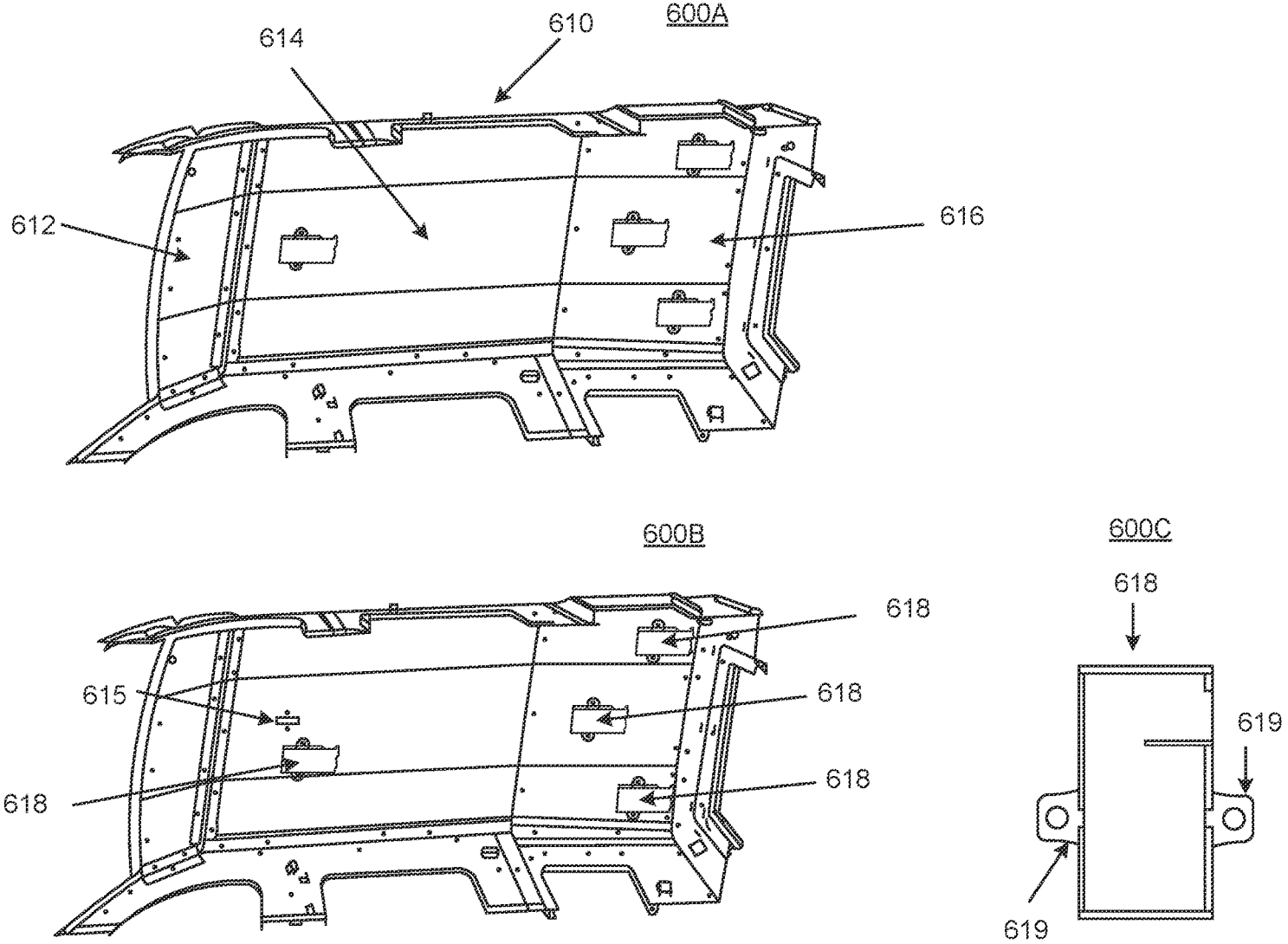
FIG. 6 illustrates interior ceiling views of modular armored components for a vehicle according to one embodiment of the present disclosure.

FIG. 6 illustrates interior ceiling views 600A, 600B, and 600C of modular armored components for a vehicle according to one embodiment of the present disclosure.

In an embodiment, the modular armored components may include an armored roof component 610 configured to be removably affixed to corresponding upper portions of a first side armored component distally opposed from a second armored side component. For example, the armored roof component 610 may include a forward roof section 612, a middle roof section 614, and a rear roof section 616, wherein the forward roof section 612 is laterally secured to the middle roof section 614, and the middle roof section 614 is laterally secured to the rear roof section 616. Further, for example, the armored roof component 610 may include a plurality of roof pass throughs 615 (e.g., 4 roof access points) defined throughout the body of the armored roof component 610 defining openings with similar dimensions of the firewall access points, wherein an armor cover plate may be removably attached to and covering the roof pass throughs 615. In an embodiment, the armor cover plates 618 may include bolt flanges secured to opposing sides of the armor cover plates 618 defining an opening therein to receive a bolt for securing the armor cover plates 618 to the body of the armored roof component 610. Further, for example, the armor cover plates 618 may include dimensions that extend up to 1" beyond the opening size of the roof access points and spaced ¾" off the armored roof component 610. In an embodiment, the size of the armor cover plates may be based on the required pass through openings or access points in the modular armored components.

Figure 7:
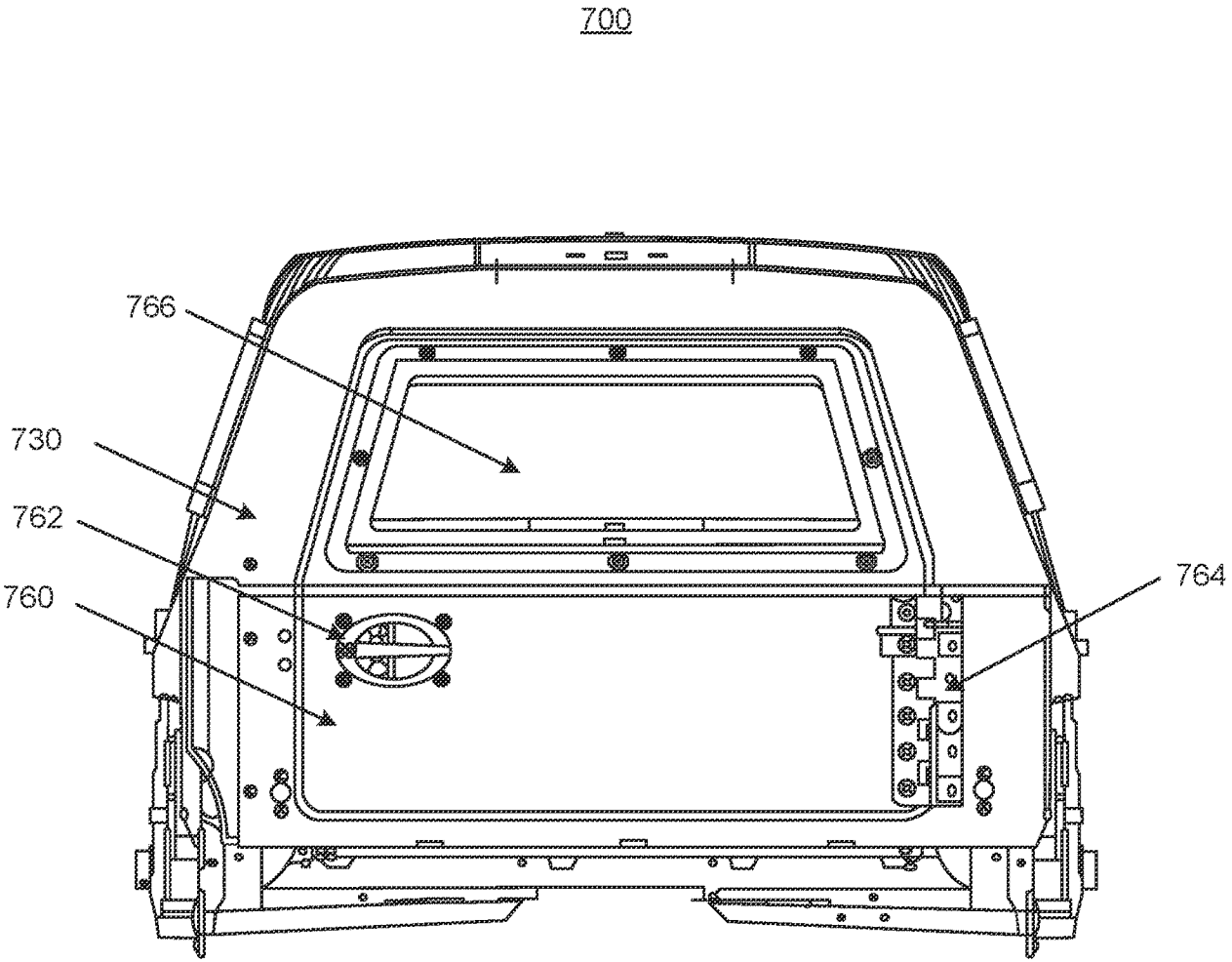
FIG. 7 illustrates a rear view of modular armored components for a vehicle according to one embodiment of the present disclosure.

FIG. 7 illustrates a rear view 700 of modular armored components for a vehicle according to one embodiment of the present disclosure.

In an embodiment, the modular armored components for a vehicle may include a rear ballistic swing door armored component 760 removably secured to the rear armored component 730 via an armored hinge component 762 (e.g., armored hinge mount) and an armored door latch 764. In an embodiment, the rear ballistic swing door component 760 may include an opening configured to secure transparent armor (e.g., armored rear windshield 766) via opaque armor returns secured within the frame of the opening, wherein the transparent armor may be secured to the rear ballistic swing door component 760 by bolting to the exterior of the rear ballistic swing door component 760 with weld nuts or studs, for example. In an embodiment, the rear ballistic swing door component 760 may include a frame comprising returns installed around the rear ballistic swing door component 760 full perimeter, wherein the returns may be the same or within 1%-10% of the same thickness of the rear ballistic swing door component 760 thickness. Further, the frame of the rear ballistic swing door component 760 may be located between the rearmost pillars of the rear armored component 730. In an embodiment, the rear ballistic swing door armored component 760 may include returns installed around the full perimeter of the rear ballistic swing door armored component 760, wherein the returns shall be the same thickness as the rear ballistic swing door armored component 760. Further, the frame of the rear ballistic swing door armored component 760 may be located between the rear most pillars.

Figure 8:
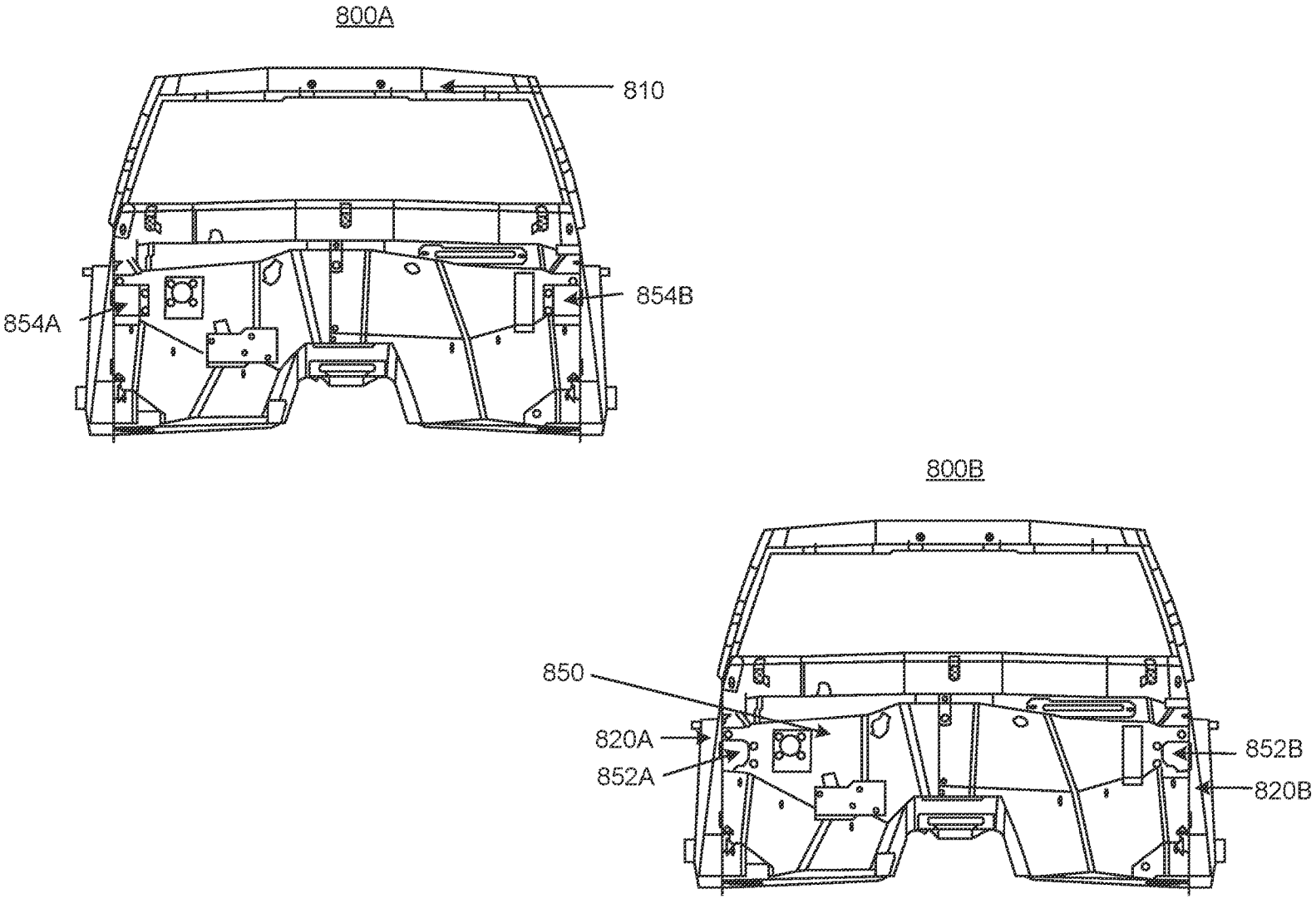
FIG. 8 illustrates front views of modular armored components for a vehicle according to one embodiment of the present disclosure.

FIG. 8 illustrates front views 800A and 800B of modular armored components for a vehicle according to one embodiment of the present disclosure.

In an embodiment, the modular armored components for a vehicle may include a firewall armored component 850 configured to be removably affixed to the vehicle frame, wherein the firewall armored component 850 may include an upper portion removably affixed to an armored roof component 810 and a first side portion removably affixed to a first side armored component 820A and a second side portion removable affixed to a second side armored component 820B using a plurality of bolts. For example, the plurality of bolts may include armor bolts corresponding to 5/16"-18 Grade L9 Level C/D.

Further, in an embodiment, the firewall armored component 850 may include one or more firewall access points (e.g., pass throughs) defining an opening in the body of the firewall armored component 850. For example, a first firewall access point 852A may define an opening in the first side of the firewall armored component 850 proximate to the first side armored component 820A and a second firewall access point 852B may define an opening in the second side of the firewall armored component 850 proximate to the second side armored component 820B. Additionally, for example, the firewall armored component 850 may include armored cover plates secured to the body of the firewall armored component 850 and extending beyond the opening of the firewall access points. For example, a first armored cover plate 854A and/or a second armored covered plate 854B may extend beyond the opening size of the firewall access points by up to 1" to provide sufficient coverage to protect against ballistics, projectiles, or any other intrusive member or energy source entering the vehicle passenger compartment. In an embodiment, the one or more firewall access points may have dimensions corresponding to a diameter of 1.5", or 1.5" length by 3.0" width, wherein the dimensions may vary within a tolerance of +/−3" to accommodate pass through access of wires, cables, or other power or communication mediums between the passenger compartment and the engine compartment.

Figure 9:
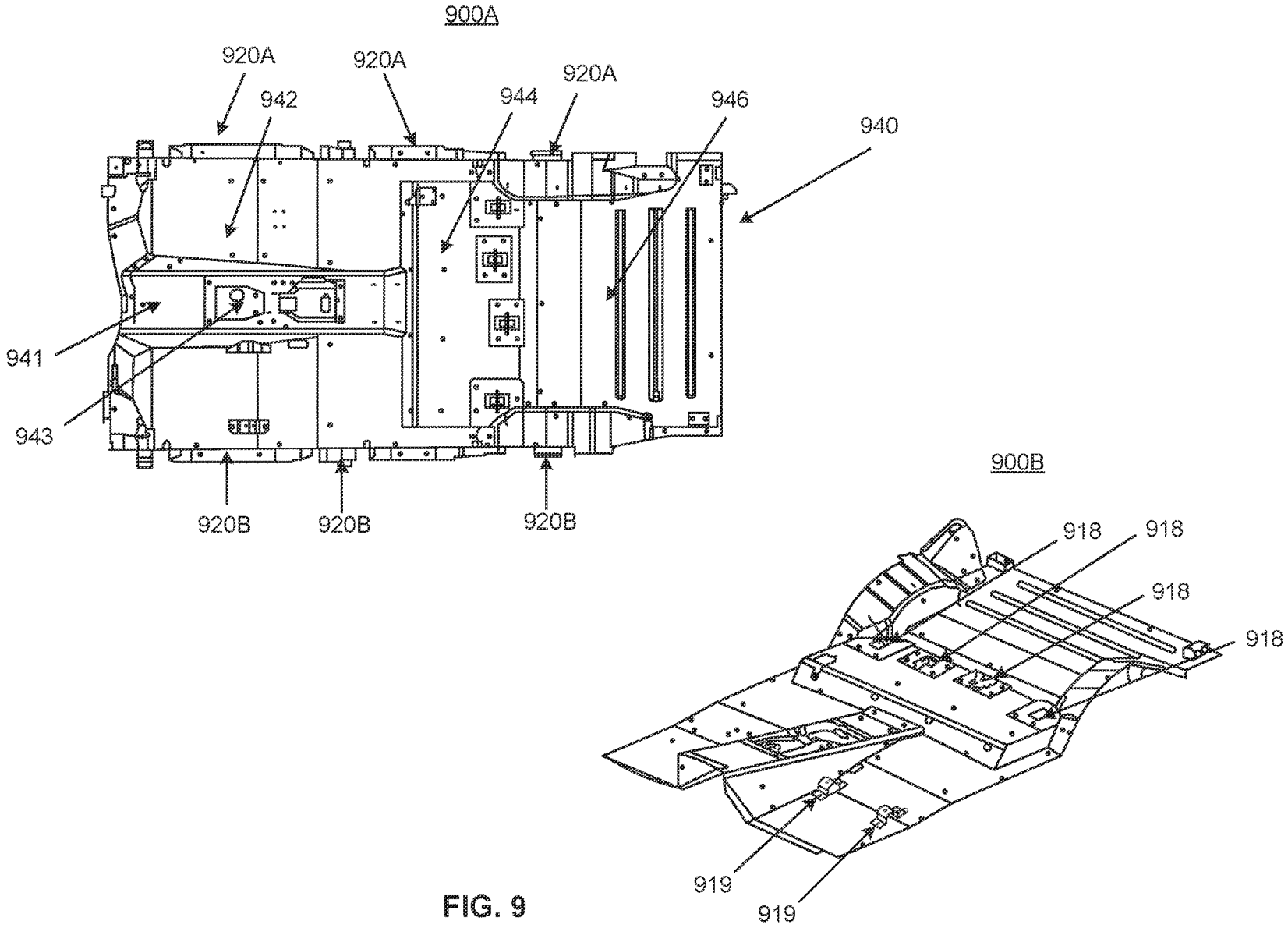
FIG. 9 illustrates top and perspective views of a floor for modular armored components for a vehicle according to one embodiment of the present disclosure.

FIG. 9 illustrates top and perspective views 900A and 900B of a floor for modular armored components for a vehicle according to one embodiment of the present disclosure.

In an embodiment, the modular armored components for a vehicle may include a floor panel armored component 940 configured to be removably affixed to the undercarriage of the vehicle frame. For example, the floor panel armored component 940 may include upper side portions removably affixed to corresponding bottom portions of the first side armored component 920A and the second side armored component 920B. Further, in an embodiment, the floor panel armored component 940 may include a forward floor section 942, a middle floor section 944, and a rear floor section 946, wherein the forward floor section 942 is laterally secured to the middle floor section 944, and the middle floor section 944 (e.g., second row seat floor) is laterally secured to the rear floor section 946 (e.g., cargo floor). Further, for example, the floor panel armored component 940 may include a plurality of floor pass throughs 918 (e.g., 4 floor panel access points) defined throughout the body of the floor panel armored component 940 defining covered openings with similar dimensions of the firewall access points, wherein an armor cover plate may be removably attached to and covering the floor pass throughs 918 (e.g., seat mounts). For example, floor pass throughs (e.g., seat mounts) may be installed to protrude through the floor panel armored component 940, thus may be manufactured to be of equal or greater resistance than the adjacent middle floor section 944.

In an embodiment, floor panel armored component 940 may include raised bracket portions 919 secured to a top surface of the forward floor section 942. For example, the raised bracket portions 919 may correspond to floor mounts used to secure passenger seats to the armored floor.

In an embodiment, floor panel armored component 940 may include a center floor portion 941 (e.g., transmission tunnel) disposed within the length of the forward floor section 944 and abutting a forward portion of the middle floor section 944, wherein the center floor portion 941 may include a transmission tunnel pass through 943 to provide cable or wire access between the vehicle interior and the vehicle exterior or the engine compartment.

Figure 10:
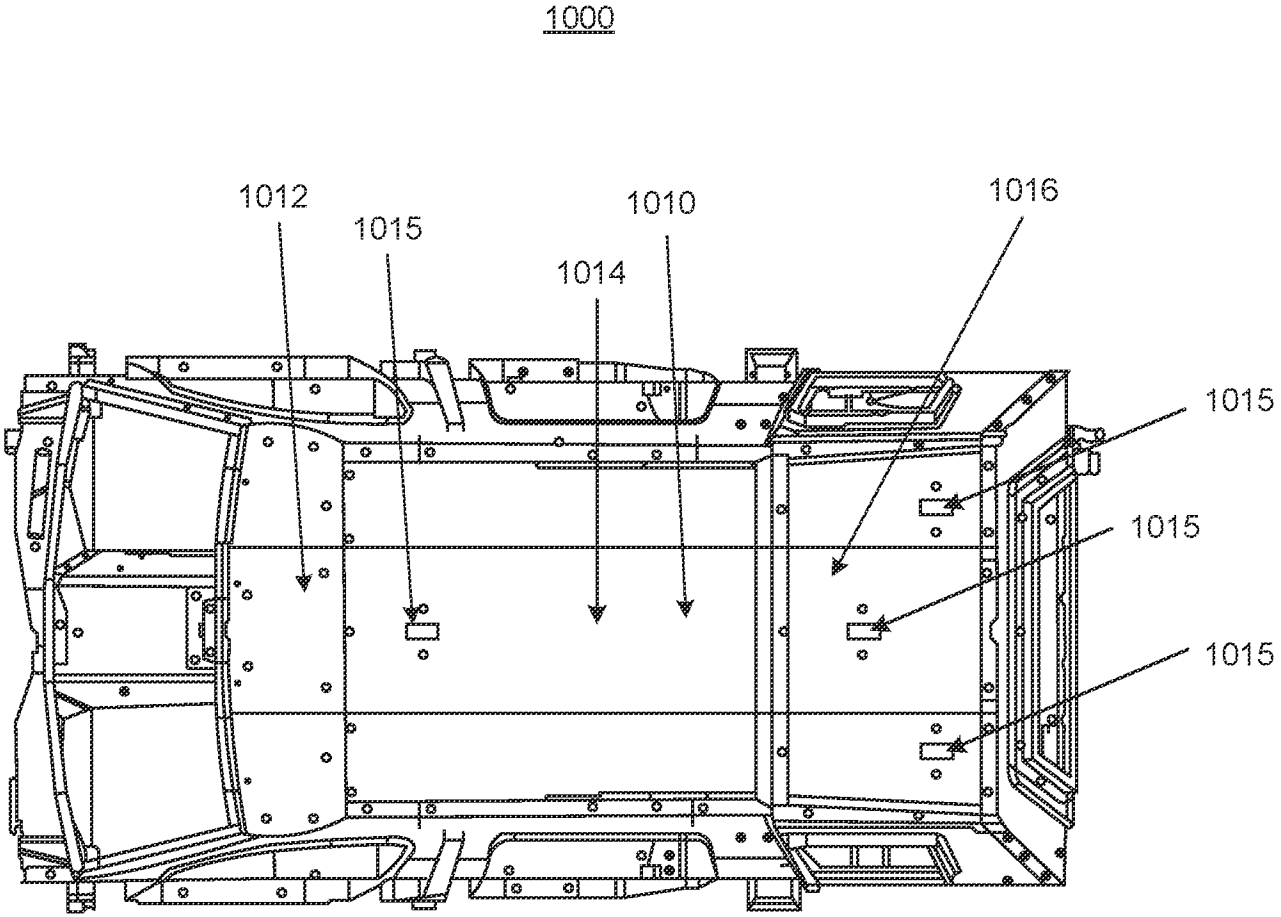
FIG. 10 illustrates a top view of modular armored components for a vehicle according to one embodiment of the present disclosure.

FIG. 10 illustrates a top view 1000 of modular armored components for a vehicle according to one embodiment of the present disclosure.

In an embodiment, the modular armored components may include an armored roof component 1010 configured to be removably affixed to corresponding upper portions of a first side armored component distally opposed from a second armored side component. For example, the armored roof component 1010 may include a forward roof section 1012, a middle roof section 1014, and a rear roof section 1016, wherein the forward roof section 1012 is laterally secured to the middle roof section 1014, and the middle roof section 1014 is laterally secured to the rear roof section 1016. Further, for example, the armored roof component 1010 may include a plurality of roof pass throughs 1015 (e.g., 4 roof access points) defined throughout the body of the armored roof component 1010 defining openings with similar dimensions of the firewall access points, wherein an armor cover plate may be removably attached to the interior surface of the armored roof component 1010 and covering the roof pass throughs 1015.

Figure 11:
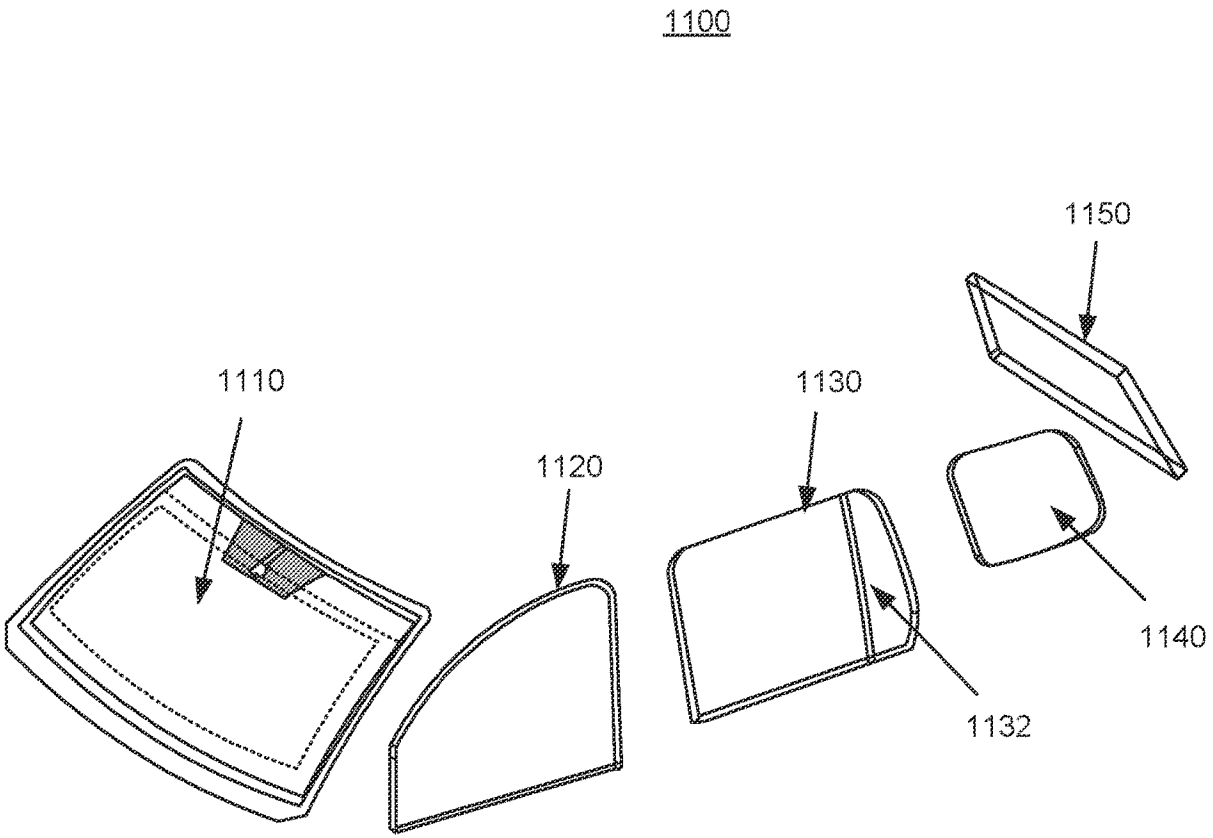
FIG. 11 illustrates views of transparent armor of modular armored components for a vehicle according to one embodiment of the present disclosure.

FIG. 11 illustrates views 1100 of transparent armor of modular armored components for a vehicle according to one embodiment of the present disclosure.

In an embodiment, modular armored components may include transparent armor corresponding to one or more of a windshield 1110, front door transparent armor 1120, rear door transparent armor 1130, rear quarter transparent armor 1140, and a rear bulkhead transparent armor 1150 configured to be secured within respective window openings of the modular armored components. For example, the front door transparent armor 1120 and cargo transparent armor (e.g., rear quarter transparent armor 1140 and a rear bulkhead transparent armor 1150) may include a perimeter paint band and the rear door transparent armor 1130 may include a paint divider band 1132. In an embodiment, the paint band on all transparent armor may extend slightly beyond the frame of the transparent armor to obscure interior armor and the windshield 1110 may include a 5 mm wide gradient (e.g., dot matrix) transition from solid paint band.

In an embodiment, the transparent armor may be installed in a way to provide the greatest daylight opening possible (as viewable from the driver seat) and the window assembly may be bolted to the exterior of the rear ballistic swing door armored component 760 assembly with weld nuts or studs.

In an embodiment, the modular armored components may be composed of materials corresponding to MIL-DTL-12560, MIL-DTL-46100, or MIL-DTL-32332. Other modular armored component material compositions and/or material dimensions may be determined based on the requirements of the application, wherein the requirements may be threat-specific. In an embodiment, the modular armored components may include camera mounting and protective coating, wherein each vehicle shall have provisions for mounting cameras that have 360-degree views of its surroundings. For example, camera mounting provisions may include 16-gauge steel that may be 2.5" in width and 0.75" in thickness or tall, wherein the length is based on each location. Further, the armored windshield component may include a mounted camera at 4" long centered above the windshield within 4" of the trimmed opening. Further, for example, a mounted camera may be secured above to the rearmost doors 4" above the trimmed opening. Even further, a camera mounting may be secured proximate to the rear quarter windows 7.0" long, extending at least 2.0" on either side of the window center, above and below the trimmed opening, and between 3.0-7.0 from the trimmed opening.

In an embodiment, for example, all surfaces of all opaque armor panels shall be coated with a corrosion-resistant material (e.g., MPI #79 or DP90) in a manner which will ensure a smooth surface. For example, to secure the modular armored components, the mounting structures may be integrated for camera at specified locations, wherein current Macropoxy epoxy pain products may be used for the coating.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

What is claimed is:

1. A modular armored vehicle system, comprising:

a plurality of armored components removably affixed to a vehicle frame, the plurality of armored components comprising an armored roof component comprising a forward roof section, a middle roof section and a rear roof section, wherein each of the plurality of armored components comprise a plurality of bends to form-fit onto the vehicle frame;

a first side armored component of the plurality of armored components removably affixed to the vehicle frame, wherein the first side armored component comprising a flange portion to overlap the armored roof component; and a side pillar armored component of the plurality of armored components removably affixed to the vehicle frame.

2. The modular armored vehicle system of claim 1, further comprising a firewall armored component removably affixed to the vehicle frame, the firewall armored component disposed between an engine compartment of the vehicle and a passenger compartment of the vehicle.

3. The modular armored vehicle system of claim 1, further comprising a rear armored component removably affixed to the vehicle frame.

4. The modular armored vehicle system of claim 1, further comprising a rear lower armored component removably affixed to the vehicle frame.

5. The modular armored vehicle system of claim 1, further comprising a floor panel armored component removably affixed to the vehicle frame.

6. The modular armored vehicle system of claim 1, wherein the armored components are removably affixed to the vehicle frame using a plurality of bolts.

7. The modular armored vehicle system of claim 1, wherein the armored components are formed of ballistic-rated steel.

8. The modular armored vehicle system of claim 1, wherein the modular armored components comply with an Overseas Security Policy Board (OSPB) blast/impact specifications.

9. A modular armored vehicle apparatus, comprising:

an armored roof component comprising a forward roof section, a middle roof section, and a rear roof section, wherein the forward roof section is laterally secured to the middle roof section, and the middle roof section is laterally secured to the rear roof section;

a first side armored component vertically secured to the armored roof component, the first side armored component comprising a first forward section defining a first front passenger door and a first rear section defining a first rear passenger door;

a second side armored component distally opposed to the first side armored component and vertically secured to the armored roof component, the second side armored component comprising a second forward section defining a second front passenger door and a second rear section defining a second rear passenger door; and a rear armored component secured to corresponding rear portions of the armored roof component, the first side armored component, and the second side armored component, wherein the rear armored component comprises a rear armored ballistic swing door secured using an armored hinge component.

10. The modular armored vehicle apparatus of claim 9, further comprising:

a firewall armored component secured to corresponding front portions of the first side armored component and the second side armored component, wherein the firewall armored component is disposed between an engine compartment and a passenger compartment of a vehicle frame.

11. The modular armored vehicle apparatus of claim 10, further comprising:

a floor panel armored component secured to corresponding bottom portions of the first side armored component, the second side armored component, and the firewall armored component, wherein the armored roof component, the first side armored component, the second side armored component, the rear armored component, and the firewall armored component are secured to the vehicle frame using a plurality of bolts.

12. The modular armored vehicle apparatus of claim 9, further comprising:

a rear lower armored component comprising an upper portion secured to a lower portion of the rear armored component and comprising forward portions secured to corresponding lower rear portions of the of the first side armored component and the second side armored component.

13. The modular armored vehicle apparatus of claim 9, further comprising:

a first side pillar component secured to a first exterior surface of the first side armored component, wherein the first side pillar component comprises first armored hinge components to secure first passenger doors to the first side armored component.

14. The modular armored vehicle apparatus of claim 9, further comprising:

a second side pillar component secured to a second exterior surface of the second side armored component, wherein the second side pillar component comprises second armored hinge components to secure a second passenger doors to the second side armored component.

15. A modular armored vehicle system, comprising:

an armored roof component comprising a forward roof section, a middle roof section, and a rear roof section, wherein the forward roof section is laterally secured to the middle roof section, and the middle roof section is laterally secured to the rear roof section;

a first side armored component vertically secured to the armored roof component, the first side armored component comprising a first forward section defining a first front passenger door and a first rear section defining a first rear passenger door;

a second side armored component distally opposed to the first side armored component and vertically secured to the armored roof component, the second side armored component comprising a second forward section defining a second front passenger door and a second rear section defining a second rear passenger door; and a rear armored component secured to corresponding rear portions of the armored roof component, the first side armored component and the second side armored component, the rear armored component comprising a rear armored ballistic swing door secured using an armored hinge component.

16. The modular armored vehicle system of claim 15, further comprising:

a firewall armored component secured to corresponding front portions of the first side armored component and the second side armored component, wherein the firewall armored component is disposed between an engine compartment and a passenger compartment of the vehicle frame.

17. The modular armored vehicle system of claim 16, further comprising:

a floor panel armored component secured to corresponding bottom portions of the first side armored component, the second side armored component, and the firewall armored component, wherein the armored roof component, the first side armored component, the second side armored component, the rear armored component, and the firewall armored component are secured to the vehicle frame using a plurality of bolts.

18. The modular bolted armored vehicle system of claim 15, further comprising:

a rear lower armored component comprising an upper portion secured to a lower portion of the rear armored component and comprising forward portions secured to corresponding lower rear portions of the of the first side armored component and the second side armored component.

19. The modular bolted armored vehicle system of claim 15, further comprising:

a first side pillar component secured to a first exterior surface of the first side armored component, wherein the first side pillar component comprises first armored hinge components to secure first passenger doors to the first side armored component.

20. The modular bolted armored vehicle system of claim 15, further comprising:

a second side pillar component secured to a second exterior surface of the second side armored component, wherein the second side pillar component comprises second armored hinge components to secure a second passenger doors to the second side armored component.

* * * * *